United States Patent [19]

Weissner

[11] Patent Number: 4,497,152

[45] Date of Patent: Feb. 5, 1985

[54] DISAPPEARING ANCHOR

[75] Inventor: David W. Weissner, Patchogue, N.Y.

[73] Assignee: Meyco Products, Inc., Hicksville, N.Y.

[21] Appl. No.: 413,674

[22] Filed: Sep. 1, 1982

[51] Int. Cl.[3] ..... E04B 1/38

[52] U.S. Cl. ..... 52/709; 52/166; 119/125

[58] Field of Search ..... 52/295, 709, 166; 119/125; 410/83, 90, 91, 107, 111; 411/347, 349, 549, 550, 551, 552, 553

[56] References Cited

U.S. PATENT DOCUMENTS

| | | | |
|---|---|---|---|
| 581,065 | 4/1897 | Conner | 119/125 |
| 634,672 | 10/1899 | Perry | 52/295 |
| 2,922,211 | 1/1960 | Boyd | 411/551 |
| 3,042,161 | 7/1962 | Meyer | 52/709 |
| 3,102,708 | 9/1963 | Crain | 410/107 |

*Primary Examiner*—John E. Murtagh
*Assistant Examiner*—Kathryn L. Ford
*Attorney, Agent, or Firm*—Brumbaugh, Graves, Donohue & Raymond

[57] ABSTRACT

A disappearing anchor for mounting in a wooden surface, for example, a deck surrounding a swimming pool, is provided. In accordance with the invention, a collar member comprising an axial sleeve defining a central aperture and a radially extending flange is provided. The aperture accommodates the upper end of the cylindrical housing of the anchor device, and is mounted, for example by press-fitting, so that the upper surface of the radially extending flange is flush with the upper surface of the cylindrical housing. The anchor and fixed collar are then placed in the wooden deck which is counterbored so that the top surface of the radially extending flange is flush with the wooden deck.

4 Claims, 2 Drawing Figures

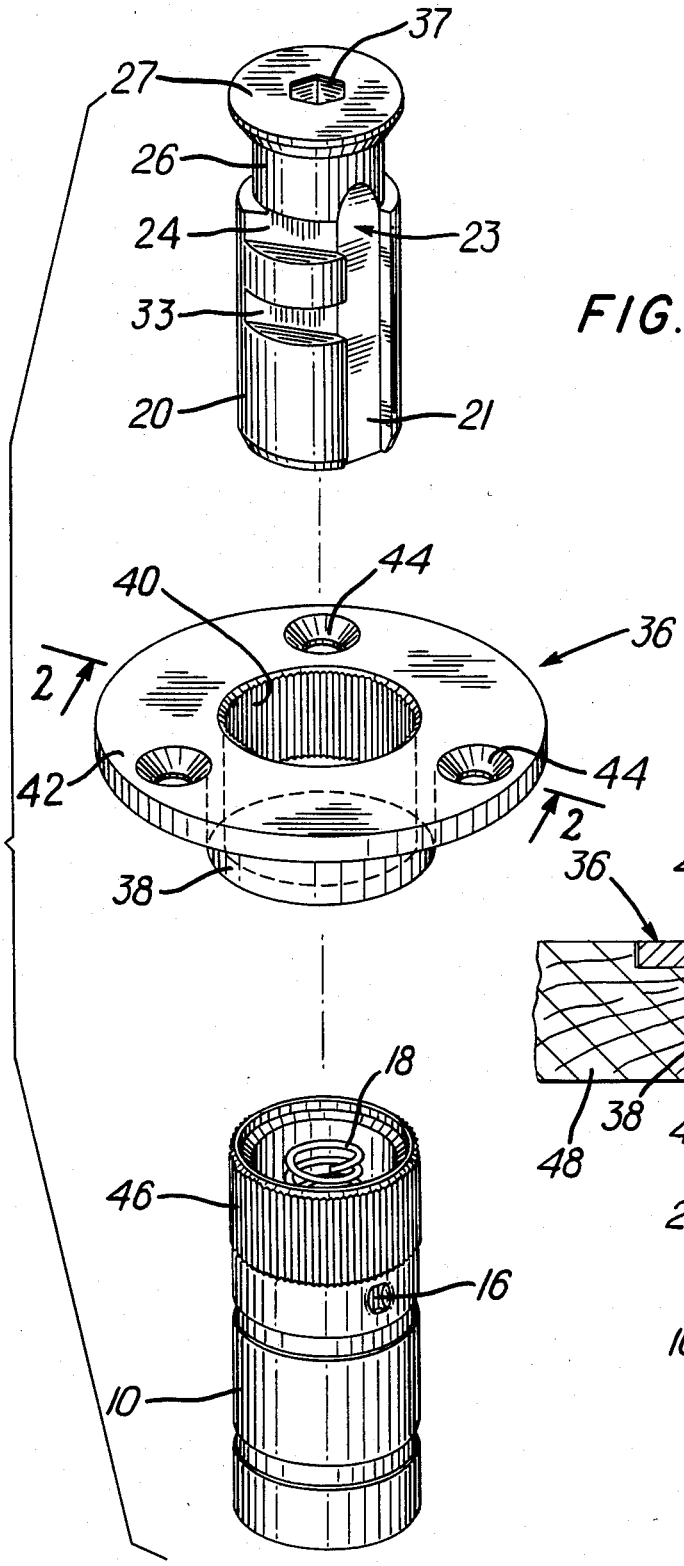
FIG. 1
FIG. 2
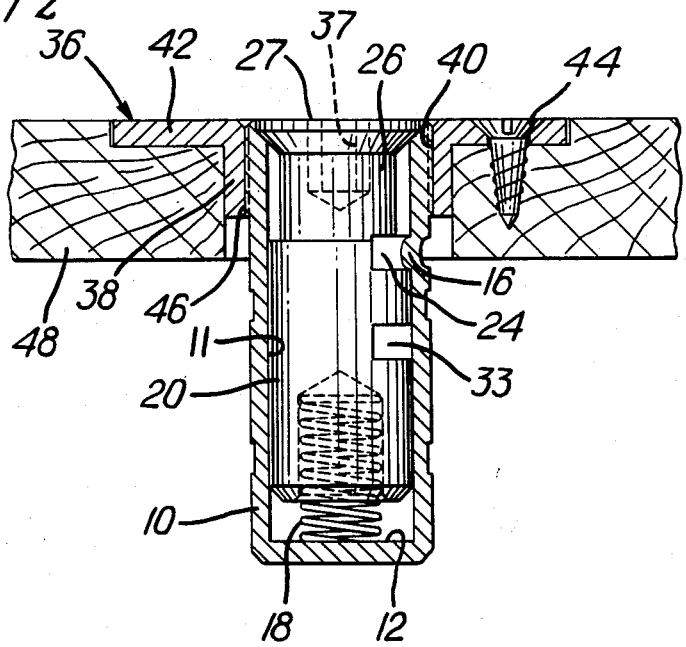

DISAPPEARING ANCHOR

BACKGROUND OF THE INVENTION

This invention relates to anchors for providing a means for attaching a flexible line, cable or the like, and more particularly to an anchor which, when not in use, presents a top surface which is flush with the surface of the material in which it is mounted.

Disappearing anchors which are embedded in material such as the ground or concrete are known in the art. One known anchor comprises an outer cylindrical housing which is provided with a series of vertical serrations on the outer surface thereof. The serrations present an irregular surface for increasing the frictional force between the housing and the material in which the anchor is embedded.

However, if the material in which the anchor is to be embedded is, for example, a wooden deck (such as would surround a swimming pool, the anchor being used to secure a pool cover over the pool when not in use), the outer surface serrations of this known anchor would not be sufficient to maintain the anchor securely within the wooden deck.

SUMMARY OF THE INVENTION

Accordingly, it is an object of the present invention to provide a disappearing anchor which can be securely mounted in a surface other than concrete.

Specifically, it is an object of the present invention to provide a disappearing anchor which can be mounted so that its top surface is flush in a wooden deck.

These and other objects are accomplished by providing a disappearing anchor comprising an outer cylindrical housing fitted, at its upper end with respect to the material in which it is embedded, with an annular collar having an axial sleeve which defines a central aperture to accommodate the housing. The collar has a radial flange at its upper end, and is mounted on the outer cylindrical housing so that the top surface of the radial flange is flush with the top surface of the outer cylindrical housing. The flange is provided with a plurality of countersunk holes through which nails, screws or the like are inserted to fix the anchor to the wooden deck and present a flush surface therewith.

Preferably, the inner surface of the axial sleeve of the collar, and a region of the outer surface of the cylindrical housing which is coextensive with the axial length of the sleeve, are provided with knurls so that the two members may be press-fit, although other means may be employed for fixing the two members together, such as screw threads. Alternately, the collar and housing may be manufactured as a unitary structure.

BRIEF DESCRIPTION OF THE DRAWINGS

For a better understanding of the invention, the scope of which will be pointed out in the appended claims, reference is made to the accompanying drawings, wherein:

FIG. 1 is an exploded view in perspective of a disappearing anchor constructed in accordance with the present invention; and FIG. 2 is a view in partial cross section of the anchor of FIG. 1 mounted in a wooden deck taken along the line 2—2 in FIG. 1.

DESCRIPTION OF EXEMPLARY EMBODIMENT

Referring to an exemplary embodiment of the invention, and with particular reference to FIG. 1, the disappearing anchor constructed in accordance with the present invention comprises a cylindrical housing 10 having an axial bore 11 extending along its length.

At least one knob 16 projects from the inner surface of the bore 11. A coiled compression spring 18 is positioned within the bore so that its lower end abuts the bottom 12 of the cylinder 10.

A plunger 20, formed to fit slidably within the bore 11, is provided with a groove 21 which extends upwardly in the surface of the plunger 20 and terminates in an enlarged opening 23. The groove 21 and opening 23 are adapted to receive the knob 16.

A shoulder 24, defined by the enlarged opening 23, engages the knob 16 to lock the plunger 20 completely within the housing 10 against the action of the spring 18 when such is desired. To maintain the anchor in a raised, operative position, a slot 33 extends horizontally from the groove 21. The operation of the plunger 20 is fully described in commonly-owned U.S. Pat. No. 3,042,161, which is hereby incorporated by reference, and a further discussion of the operation thereof is not essential to an understanding of the invention disclosed herein.

In accordance with the present invention, the anchor further comprises a collar member 36 having an axially extending sleeve 38, the inner surface of which is provided with knurls 40. The collar 36 has a radially extending flange 42 having a plurality of holes 44 through which nails, or preferably, screws, are inserted to fix the anchor securely in the wooden deck or such other material in which the anchor is to be mounted. The holes 44 are preferably countersunk so that the heads of the screws or nails are flush with the top of the flange 42.

In the illustrative embodiment, the housing 10 has a region which is coextensive with the axial length of the sleeve 38, and which also has knurls 46 so that the collar member 36 and the housing 10 may be press-fit together.

The sleeve 38 and knurled outer surface of the cylinder 10 are dimensioned so that the upper surface of the radial flange 42 is flush with the upper surface 32 of the housing 10 when the collar 36 is fixed on the housing 10. When the wooden deck 48 is bored to accommodate the anchor it is counterboard to define a shoulder which will accommodate the radial flange 42. Thus, the top surface of the flange 42, the top surface 32 of the cylindrical housing 10 and the wooden deck are all flush with each other to present a smooth surface when the plunger 20 is depressed into and locked within the housing 10.

Alternatively, the inner surface of the sleeve 38 and the outer surface of the housing 10 could be provided with screw threads by which two members could be securely fixed to each other, or the housing 10 and collar 36 could be manufactured as a unitary structure.

Although the invention has been described in conjunction with an illustrated exemplary embodiment, it will be obvious to those skilled in the art that variations and modifications may be made thereto without departing from the inventive concepts disclosed. All such variations and modifications which fall within the spirit of the invention are intended to fall within the scope of the appended claims.

I claim:

1. In an anchor device comprising a housing having an axial bore opening externally at its upper end, a substantially cylindrical plunger element forming a part of said anchor device and adapted to fit slidably within said axial bore and to be locked against the force of a spring means within said housing in at least one of a first position in which a top surface of said plunger is flush with a top surface of said cylindrical housing, and a second extended position in which said plunger element is locked so that its top surface is at a distance above said top surface of said cylindrical housing thereby presenting a neck to which an object to be secured by said anchor is fixed, the improvement wherein said anchor device further comprises a means for fixing said anchor in a wooden surface comprising a collar member having an axial sleeve defining a central aperture, and a radially extending flange, wherein an inner surface of said axial sleeve and an outer surface of said cylindrical housing axially coextensive with said inner surface of said axial sleeve are each provided with cooperating means for fixing said collar member to said cylindrical housing so that an upper surface of said radial flange is flush with said top surface of said cylindrical housing.

2. An anchor device in accordance with claim 1, wherein said radial flange has a plurality of holes extending axially therethrough for receiving at least one of nails and screws for fixing said anchor device in a material in which it is to be mounted.

3. An anchor device in accordance with claim 1, wherein said cooperating means comprise knurls, whereby said collar member and said cylindrical housing are press-fit together.

4. An anchor device in accordance with claim 1, wherein said cooperating means comprise screw threads.

* * * * *